US008926426B2

(12) United States Patent
Frerking

(10) Patent No.: US 8,926,426 B2
(45) Date of Patent: Jan. 6, 2015

(54) METHODS AND APPARATUS FOR A DISTRIBUTED BONUS SCHEME USING SIMULATED SCATTER REACTIONS

(71) Applicant: Aristocrat Technologies Australia Pty Limited, North Ryde (AU)

(72) Inventor: Gary Frerking, Henderson, NV (US)

(73) Assignee: Aristocrat Technologies Australia Pty Limited, North Ryde (AU)

( * ) Notice: Subject to any disclaimer, the term of this patent is extended or adjusted under 35 U.S.C. 154(b) by 69 days.

(21) Appl. No.: 13/733,779

(22) Filed: Jan. 3, 2013

(65) Prior Publication Data

US 2013/0122984 A1 May 16, 2013

Related U.S. Application Data

(63) Continuation of application No. 13/024,813, filed on Feb. 10, 2011, now Pat. No. 8,366,543.

(51) Int. Cl.
*G07F 17/32* (2006.01)

(52) U.S. Cl.
USPC ..... 463/29; 463/16; 463/20; 463/25

(58) Field of Classification Search
USPC ..... 463/16–20, 25–29
See application file for complete search history.

(56) References Cited

U.S. PATENT DOCUMENTS

| | | | | |
|---|---|---|---|---|
| 4,856,787 | A * | 8/1989 | Itkis | 273/237 |
| 5,655,961 | A | 8/1997 | Acres et al. | |
| 5,820,459 | A | 10/1998 | Acres et al. | |
| 5,836,817 | A | 11/1998 | Acres et al. | |
| 6,257,981 | B1 | 7/2001 | Acres et al. | |
| 6,358,149 | B1 | 3/2002 | Schneider et al. | |
| 6,364,768 | B1 | 4/2002 | Acres et al. | |
| 6,375,567 | B1 | 4/2002 | Acres | |
| 6,375,569 | B1 | 4/2002 | Acres | |
| RE37,885 | E | 10/2002 | Acres et al. | |
| 6,565,434 | B1 | 5/2003 | Acres | |
| 6,712,698 | B2 | 3/2004 | Paulsen et al. | |
| 6,722,985 | B2 | 4/2004 | Criss-Puszkiewicz et al. | |
| 6,832,958 | B2 | 12/2004 | Acres et al. | |
| 6,908,387 | B2 | 6/2005 | Hedrick et al. | |
| 7,048,628 | B2 * | 5/2006 | Schneider | 463/16 |
| 2005/0239531 | A1 | 10/2005 | Osawa | |
| 2009/0312091 | A1 | 12/2009 | Kato et al. | |

OTHER PUBLICATIONS

Notice of Allowance issued by the United States Patent and Trademark Office in connection with U.S. Appl. No. 13/024,813 on Jun. 12, 2012 (10 pages).

Notice of Allowance issued by the United States Patent and Trademark Office in connection with U.S. Appl. No. 13/024,813 on Oct. 4, 2012 (7 pages).

* cited by examiner

*Primary Examiner* — Omkar Deodhar
(74) *Attorney, Agent, or Firm* — Hanley, Flight & Zimmerman, LLC

(57) ABSTRACT

Methods and apparatus for a distributed bonus scheme using simulated scatter reactions are disclosed. An example method of operating a gaming device in a gaming system includes receiving a trigger that initiates a first bonus decision in a first gaming device. Further, the example method includes calculating, using a programmed processor, an accumulated value that defines a range. Further, the example method includes generating a random number. Further, the example method includes, when the random number falls within the range, granting a bonus to the first gaming device. Further, the example method includes determining whether the first bonus decision is to initiate a second bonus decision in a second gaming device of the gaming system.

17 Claims, 7 Drawing Sheets

METHODS AND APPARATUS FOR A DISTRIBUTED BONUS SCHEME USING SIMULATED SCATTER REACTIONS

RELATED APPLICATION

This patent arises from a continuation of U.S. patent application Ser. No. 13/024,813, filed Feb. 10, 2011, now U.S. Pat. No. 8,366,543, which is incorporated herein by reference in its entirety.

FIELD

This invention is related to methods and apparatus for a distributed bonus scheme using simulated scatter reactions.

BACKGROUND

Multiple gaming devices are often grouped together to form a network. Such a network may span a casino floor and/or a plurality of facilities, properties, casinos, networks, etc. The network typically includes a central host computer or computing system to manage the plurality of gaming devices and/or different aspect(s) thereof. In typical gaming networks, one or more central host computers control which of the networked gaming devices receive one or more bonuses at a given time and/or over a period of time.

SUMMARY

An example method of operating a gaming device in a gaming system includes receiving a trigger that initiates a first bonus decision in a first gaming device. Further, the example method includes calculating, using a programmed processor, an accumulated value that defines a range. Further, the example method includes generating a random number. Further, the example method includes, when the random number falls within the range, granting a bonus to the first gaming device. Further, the example method includes determining whether the first bonus decision is to initiate a second bonus decision in a second gaming device of the gaming system.

An example gaming device of a gaming system includes a receiver to receive a trigger that initiates a first bonus decision in a first gaming device. Further, the example gaming device includes an accumulator to calculate an accumulated value that defines a range. Further, the example gaming device includes a random number generator to generate a random number. Further, the example gaming device includes a comparator to determine whether the random number falls within the range, wherein the first bonus decision results in a granted bonus when the random number falls within the range, and wherein the comparator is to determine whether the first bonus decision is to initiate a second bonus decision in a second gaming device of the gaming system.

An example tangible machine readable medium has instructions stored thereon that, when executed, cause a machine to receive a trigger that initiates a first bonus decision in a first gaming device. Further, the example tangible machine readable medium as instructions stored thereon that, when executed, cause the machine to calculate an accumulated value that defines a range. Further, the example tangible machine readable medium as instructions stored thereon that, when executed, cause the machine to generate a random number. Further, the example tangible machine readable medium as instructions stored thereon that, when executed, cause the machine to, when the random number falls within the range, grant a bonus to the first gaming device. Further, the example tangible machine readable medium as instructions stored thereon that, when executed, cause the machine to determine whether the first bonus decision is to initiate a second bonus decision in a second gaming device of the gaming system.

An example gaming system includes a first gaming device including a bonus module to receive a token configured to initiate a first bonus decision, the bonus module to compare an accumulated value comprising a sum of parameters to a random number to determine whether the first bonus decision results in a win or a loss, the bonus module to determine which of a plurality of segments of a range defined by the accumulated value the random number falls within, wherein each segment defines a number of scatter tokens to be generated by the first bonus decision. Further, the example gaming system includes a system bonus manager to receive one or more scatter tokens resulting from the first bonus decision on the first gaming device and to process the one or more scatter tokens. Further, the example gaming system includes a second gaming device to receive a first one of the one or more scatter tokens from the system bonus manager, the first scatter token to initiate a second bonus decision on the second gaming device.

BRIEF DESCRIPTION OF THE DRAWINGS

Certain embodiments of the invention will be described, by way of example, in relation to the accompanying drawings, in which.

Features, further aspects, and advantages of the present invention will become apparent from the following description of embodiments thereof, by way of example only, with reference to the accompanying drawings. Also, various embodiments of the aspects described in the preceding paragraphs will be apparent from the appended claims, the following description and/or the accompanying drawings. It should be understood, however, that the present invention is not limited to the arrangements and instrumentality shown in the attached drawings.

DETAILED DESCRIPTION

Although the following discloses example methods, systems, articles of manufacture, and apparatus including, among other components, software executed on hardware, it should be noted that such methods and apparatus are merely illustrative and should not be considered as limiting. For example, it is contemplated that any or all of these hardware and software components could be embodied exclusively in hardware, exclusively in software, exclusively in firmware, or in any combination of hardware, software, and/or firmware. Accordingly, while the following describes example methods, systems, articles of manufacture, and apparatus, the examples provided are not the only way to implement such methods, systems, articles of manufacture, and apparatus.

When any of the appended apparatus claims are read to cover a purely software and/or firmware implementation, in at least one embodiment, at least one of the elements is hereby expressly defined to include a tangible medium such as a memory, DVD, CD, etc. storing the software and/or firmware.

Figure 1:
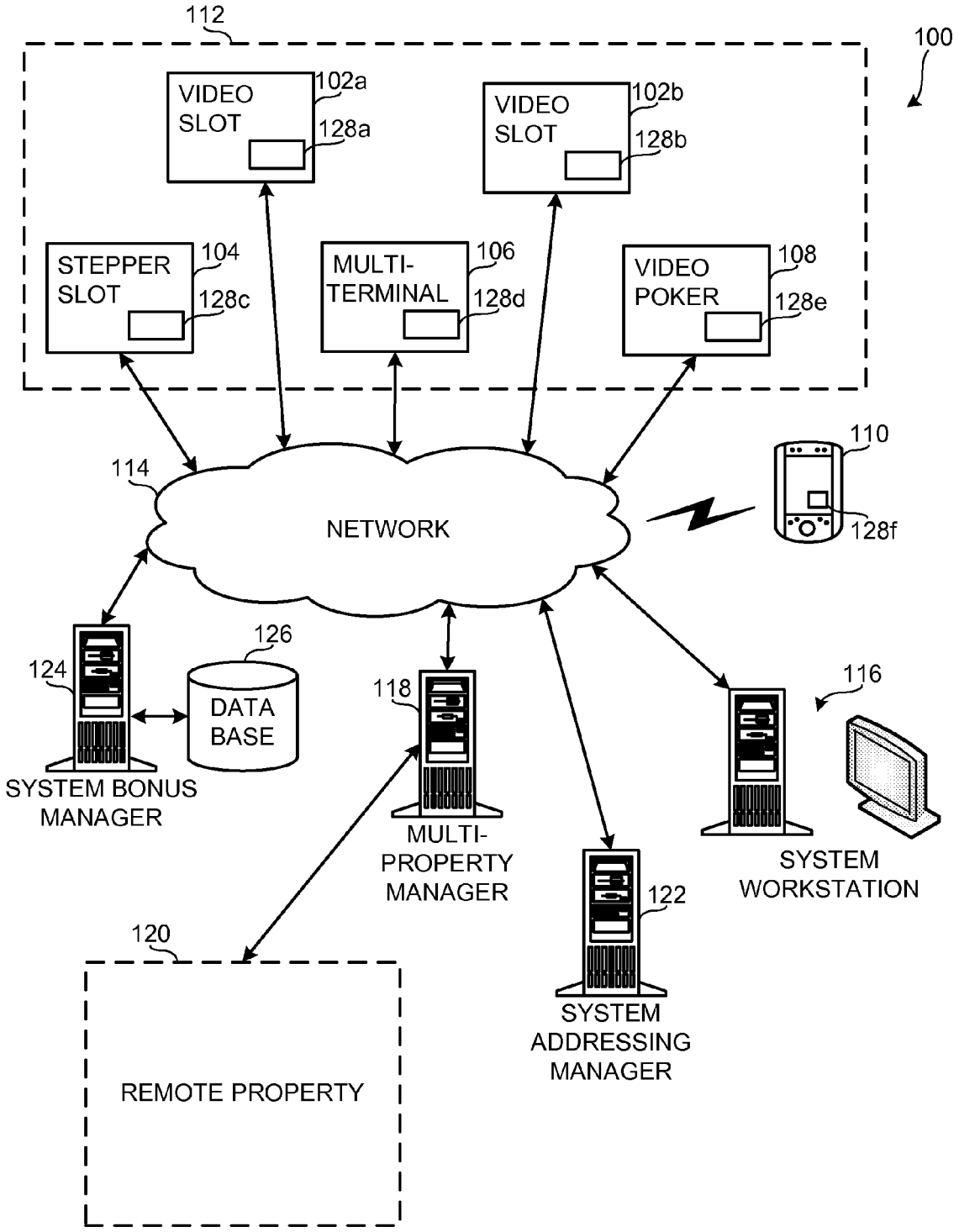
FIG. 1 is an example gaming system including a network and a plurality of gaming devices communicatively coupled to the network.

FIG. 1 is an example gaming system 100 on which the example methods, apparatus, systems, and/or articles of manufacture described may be implemented to provide a distributed bonus scheme. The example methods, apparatus, systems, and/or articles of manufacture described herein use simulated scatter reactions, such as the scatter reactions found in nuclear reactor environments, to provide a model for distributed, interactive bonus decisions to be made at individual gaming devices of a gaming system (e.g., the example gaming system 100 of FIG. 1). Distributing bonus decisions among a plurality of devices decreases processing burdens otherwise placed on central or host computer(s). As a result, the central or host computer(s) can better utilize the higher processing capabilities thereof for complex computing tasks and/or to provide a wider range of options to players, administrators, game designers, etc.

Moreover, the example methods, apparatus, systems, and/or articles of manufacture described herein enable random bonus results in individual gaming devices and, at the same time, provide predictable and controllable behavior in the bonus scheme as a whole. That is, using the example methods, apparatus, systems, and/or articles of manufacture described herein, system administrators can control the overall behavior of a gaming network and can predict the overall results of the bonus scheme of a gaming system while allowing individual devices to act randomly. Such a system increases flexibility (e.g., by providing more bonus options at individual devices), provides additional or alternative incentives for individual players, and increases player excitement and/or motivation to continue playing. Additional and alternative advantages are created by the example methods, apparatus, systems, and/or articles of manufacture described herein.

Example utilizations of simulated scatter reactions are described below in connection with the example gaming system 100 of FIG. 1. However, additional or alternative utilizations of simulated scatter reactions are possible as the examples described below are not limiting. For example, additional or alternative types and/or magnitudes of scatter reactions can be used to implement additional or alternative bonus schemes in additional or alternative gaming systems (e.g., online gaming environments).

The example gaming system 100 of FIG. 1 includes first and second video slot machines 102*a* and 102*b*, respectively, a stepper slot machine 104, a multi-terminal game 106, and a video poker machine 108. The example gaming system 100 of FIG. 1 also includes a wireless device 110 that facilitates play of one or more types of games. The wireless device 110 may be implemented by, for example, a cellular telephone, a smartphone, a mobile media player, a personal digital assistant, a wireless kiosk, and/or any other type of wireless device capable of facilitating play of a game (e.g., video poker). The wireless device 110 may facilitate one or more games over a one or more networks, such as the Internet, via, for example, a web site implemented at a server(s) capable of authenticating the wireless device 110, maintaining user account(s), enforcing online rule(s), etc.

The video slot machines 102*a* and 102*b*, the stepper slot machine 104, the multi-terminal game 106, the video poker machine 108, the wireless device 110, and/or any other device or machine capable of facilitating the play of one or more games are sometimes referred to herein as 'gaming devices.' Additionally or alternatively, the term 'gaming device' may refer to a player position and/or a virtual representation of a player position at a gaming table such as, for example, blackjack, craps, roulette, poker, baccarat, etc.

One or more of the games devices 102-110 form a gaming floor 112. In addition to or in lieu of the example wireless device 110 that may or not be located proximate the, the example gaming system 100 of FIG. 1 may include any other type of remotely located electronic device(s) capable of facilitating play of a game, such as for example, television(s), television set-top-boxe(s), mobile set-top-boxe(s), personal computer(s) (e.g., x86 compatible, Apple® compatible), kiosks, etc. In some examples, one or more of such remotely located devices may be considered part of the gaming floor 112.

In the illustrated example of FIG. 1, the example gaming devices 102-110 are coupled (e.g., wirelessly or via wired connection(s)) to a network 114. The network 114 can be implemented by one or more networks, such as, for example, a local-area network, a wide-area network, a metropolitan-area network, the Internet, a digital subscriber line (DSL) network, a cable network, a power line network, a wireless communication network, a wireless mobile phone network, a Wi-Fi network, and/or a satellite network. The network 114 enables the gaming devices 102-110 to communicate which each other and/or with additional devices of the example gaming system 100.

For example, the example gaming system 100 also includes a system workstation 116 coupled to the network 114. The example system workstation 116 enables one or more system administrators, for example, to manage one or more aspects of the example gaming system 100. For example, the system workstation 116 can be used to manage security settings, network connections, updates, scans, alterations to the gaming floor 112 (e.g., layout redesign, addition or removal of one or more machines or tables, etc.).

The example gaming system 100 also includes a multi-property manager 118 coupled to the network 114. The example multi-property manager 118 facilitates interaction(s) between different locations or properties if the gaming system 100 is configured to include more than one location or properties. In the illustrated example, the multi-property manager 118 enables the example gaming floor 112 to also include additional gaming devices located at a remote property 120. As a result, the example distributed bonus schemes described herein may be configured to facilitate a bonus scheme that spans a plurality of gaming locations or properties.

The example gaming system 100 also includes a system addressing manager 122 coupled to the network 114. The example system addressing manager 122 enables system administrator and/or operators to configure addressing settings for the casino floor 112 and the gaming devices 102-110 thereofhe addressing settings facilitate communication between the gaming device 102-110 and/or central devices, such as a system bonus manager 124.

The example system bonus manager 124 is coupled to and/or includes a database 126, which stores information related to one or more bonus schemes including, for example, the distributed bonus schemes described herein. With regards to the example distributed bonus schemes described herein, decision(s) regarding bonuses at individual gaming devices 102-110 can be made at the individual gaming devices 102-110, thereby reducing the processing burden placed on the central system bonus manager 124. However, in some examples, the system bonus manager 124 provides information (e.g., token information to be used in random number algorithms) to the individual gaming devices 102-110 that may be used in the bonus decisions of the individual gaming devices 102-110. In doing so, the example system bonus manager 124 provides control and predictability over the distributed bonus scheme as a whole so that cumulative bonus outputs can be maintained, altered for a given period of time, adjusted for a particular event, etc. The role of the system bonus manager 124 is described in greater detail below.

In the illustrated example of FIG. 1, each of the gaming devices 102-110 includes a smart communication interface (SCI) 128. The SCIs 128 are sometimes referred to as player tracking modules (PTMs) or slot monitor interface boards (SMIBs). In some examples, one or more components or functions of an SCI 128 may be combined with one or more components of functions of a corresponding gaming devices (e.g., a game computational component of the video poker machine 108) to form an integral unit.

The SCIs 128 of the example gaming system 100 implement the example distributed bonus schemes described herein, which utilize one or more simulated scatter reactions. Generally, when one of the gaming devices, such as the video slot machine 102*a*, receives a token (e.g., from a central bonus device or another one of the gaming devices 102*b*-110), that gaming device 102*a* makes a bonus decision. In other words, the token is a bonus decision trigger to initiate a bonus decision to be made by the gaming device 102*a*. The received token has a value that influences the bonus decision to be made by the gaming device that received the token. As described in detail below, the bonus decision is also influenced by one or more local and/or external parameters that impact randomness to the individual bonus decision. Depending on the value of the token and the one or more random parameters, the gaming device 102*a* decides whether the token triggered a bonus win or loss. Other aspects of the bonus decision described in detail below determine whether the bonus decision is to initiate or propagate one or more scatter reactions to one or more of the other gaming devices 102*b*-110. Thus, a random bonus decision made at an individual gaming device 102*a* also has random impact(s) on other bonus decision(s) made at other gaming device(s) 102*b*-110. However, as described below, the example methods, apparatus, systems and/or articles of manufacture described herein enable control over the cumulative bonus behavior of the casino floor 112, while maintaining the randomness of the individual bonus decisions made at the individual gaming devices 102-110.

Figure 2:
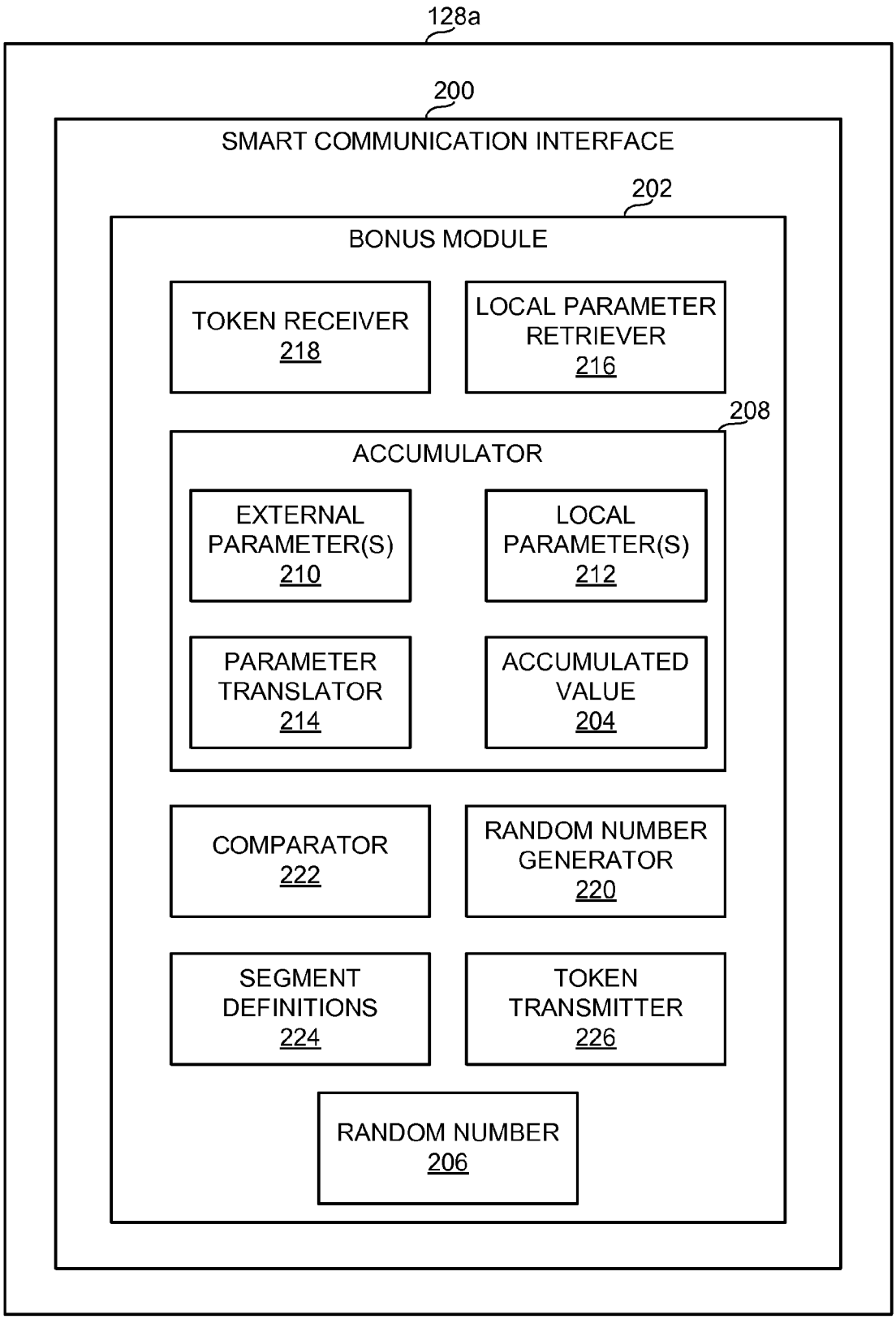
FIG. 2 is a block diagram of an example smart communication interface (SCI) of an example gaming machine.

FIG. 2 is a block diagram of an example SCI 200 of an example gaming device. For purposes of illustration the example SCI 200 corresponds to the example SCI 128*a* of the example video slot machine 102*a* of FIG. 1. However, the example SCI 200 of FIG. 2 may be implemented in connection with any of the example gaming devices 102-110 of FIG. 1 and/or any other suitable gaming devices associated with the example gaming system 100 of FIG. 1.

In addition to or in lieu of conventional components of SCIs (e.g., a communication interface to enable transmission of data to and from the SCI 200 according to one or more protocols, player tracking components, gaming components, display module(s), etc.) not shown in FIG. 2, the example SCI 200 of FIG. 2 includes a bonus module 202. Generally, the bonus module 202 of the example SCI 200 uses fixed and/or variable parameters received from external sources (e.g., as part of a token configured to trigger a bonus decision when received at the gaming device 102*a*) and/or from local resources (e.g., as gathered from local values associated with the gaming device 102*a*) to generate an accumulated value 204. The example bonus module 202 also generates a random number 206 when a bonus decision is to be made by the gaming device 102*a*.

In the illustrated example, bonus decisions are triggered in response to the SCI 200 receiving a token. Tokens are transmitted to the gaming device by the system bonus manager 124 of FIG. 1 at a time according to a schedule, in response to a command, and/or in response to the system bonus manager receiving a scatter reaction token from another one of the gaming devices 102*b*-110. As described below, a bonus decision made at one of the gaming devices (e.g., the video slot machine 102*a*) may result in a plurality of scatter tokens to be propagated to other gaming devices (e.g., the video poker machine 108 and the stepper slot machine 104). The scatter tokens also trigger bonus decisions at the gaming devices receiving the scatter tokens. In some examples, the bonus module 202 initiates a bonus decision in response to additional or alternative triggers and/or scheduled events.

To make a bonus decision when initiated and, if the bonus is granted, the nature of the bonus (e.g., the magnitude of the bonus, the type of bonus, the number of bonus(es), a number of scatter tokens to propagate to other gaming devices 102*b*-110, etc.), the example bonus module 202 compares the accumulated value 204 to the random number 206. The result of the comparison of the accumulated value 204 and the random number 206 determines what, if any, effect(s) a granted bonus has on other gaming devices (e.g., other gaming devices 102*b*-110 of the example gaming floor 112 and/or the remote property 120 of FIG. 1). That is, the randomly determined bonus decision for the example SCI 200 scatters through other gaming devices 102*b*-110 and affects bonus decision(s) made by other SCIs 128*b-f* of those gaming devices. The example effects of the distributed bonus decisions described herein on other gaming devices 102*b*-110 are described below in connection with FIGS. 3-7.

The example bonus module 202 of FIG. 2 includes an accumulator 208 to generate the accumulated value 204. The example accumulator 208 includes external parameter(s) 210, local parameter(s) 212, a parameter translator 214, and the accumulated value 204. In the illustrated example, the local parameter(s) 210 are values associated with gaming device 102*a* on which the example SCI 200 is installed. In the illustrated example, the local parameter(s) 210 are retrieved by a local parameter retriever 216 and include, for example, a local time on the gaming device 128*a*, an amount of time a current player has spent playing on the gaming device 128*a*, a location of the gaming device 128*a*, an amount of time that has passed since the last win and/or bonus on the gaming device 128*a*, a current average speed of play on the gaming device 128*a*, a theoretical win for the gaming device 128*a*, a player club level associated with a player using the gaming device 102*a*, an amount of time since the last casino visit of the player using the gaming device 102*a*, a random number (distinct from the random number 206 to be compared to the accumulated value 204) generated by a local random number generator 220, and/or a denomination of a current wager on the gaming device 128*a*. One or more of the local parameter(s) 212, such as the location of the gaming device 102*a*, can be manually set in the SCI 200 by, for example, a technician that moved the gaming device 102*a*. Additionally or alternatively, one or more of the local parameter(s) 212 can be pushed to the SCI 200 by a central system device, such as the system bonus manager 124 of FIG. 1. Pushing a local parameter 212, such a the location of the gaming device 102*a*, enables an operator to periodically review and/or adjust parameter(s) to control bonus decisions and overall bonus behavior across the casino floor 112.

The external parameter(s) 210 may be received as part of a token received by a token receiver 218 from, for example, the system bonus manager 124 of FIG. 1. In some instances, the system bonus manager 124 had conveyed the token to the token receiver 218 after receiving the a scatter token from a second one of the gaming devices 102*b*-110, such as the video poker machine 108, as a result of a bonus decision on the video poker machine 108 that resulted in the generation of one or more scatter tokens to be propagated across the casino floor 112. In some instances, the system bonus manager 124 conveys the token to the token receiver 218 according a schedule or some other type of command or event. Example external parameters 210 include a random number (distinct from the random number 206 to be compared to the accumulated value 204) generated by the system bonus manager 124 of FIG. 1, a number of gaming devices in play on the casino floor 112, a desired bonus level for the casino floor 112 and/or one or more portions of the casino floor 112, an amount of bonuses paid during a recent time window, a dollar amount of bonuses paid during a recent time window, etc. Similar to the local parameter(s) 212 described above, the external parameter(s) 210 may be set by an operator to provide the operator control over the level of bonuses being paid across the casino floor 112 as a whole. Thus, one or more of the external parameter(s) 210 can be adjusted according to, for example, a day of the week, a time of day, a time of year, etc.

The external parameter(s) and the local parameter(s) 212 are conveyed to the parameter translator 214. In the illustrated example, the parameter translator 214 translates the external parameter(s) 210 and the local parameter(s) 212 into values to be summed to form the accumulated value 204. Additionally or alternatively, one or more the external parameter(s) 210 and/or the local parameter(s) 212 can be fixed for a given gaming device (e.g., the gaming device 102*a* of FIGS. 1 and/or 2) and, thus, would not require translation using the parameter translator 214. The example parameter translator 214 of FIG. 2 utilizes a lookup table having a range of values associated with each of the external and local parameter(s) 210 and 212. Additional or alternative types of data structures (e.g., matrices, arrays, etc.) can be used by the parameter translator 214 to translate the parameter(s) 210 and 212. The ranges used by the example parameter translator 214 can be manually set by a technician and/or adjusted or updated by a central component, such as the system bonus manager 124 of FIG. 1. The lookup table, the local parameter(s) 212, and/or the external parameter(s) 210 can include additional or alternative parameters, ranges, and/or translations as those described below.

As an example, the lookup table of the parameter translator 214 of FIG. 2 indicates that the 'time on device' local parameter 212 (i.e., an amount of time the current player has been playing on the gaming device 102*a* (e.g., according to a player card inserted into the gaming device 102*a*)) translates in the following manner. For a minute field value of zero (0) to thirty minutes (30), the parameter translator 214 outputs a value of five (5) to add to the accumulated value 204. For a minute field value of thirty-one (31) to sixty (60) minutes, the parameter translator 214 outputs a value of ten (10) to add to the accumulated value 204. For a minute field value of sixty (60) or greater, the parameter translator 214 outputs a value of fifteen (15) to add to the accumulated value 204.

As another example, the lookup table of the parameter translator 214 of FIG. 2 indicates that the 'location of device' local parameter 212 translates in the following manner. For a location value of 'near front doors,' the parameter translator 214 outputs a value of two (2) to add to the accumulator value 204. For a location value of 'near buffet,' the parameter translator 214 outputs a value of five (5) to add to the accumulator value 204. For a location value of 'near center of floor,' the parameter translator 214 outputs a value of ten (10) to add to the accumulator value.

As another example, the lookup table of the parameter translator 214 of FIG. 2 indicates that the 'player club level' local parameter 212 translates in the following manner. For a level of bronze, the parameter translator 214 outputs a value of three (3) to add to the accumulator value 204. For a level of silver, the parameter translator 214 outputs a value of five (5) to add to the accumulator value 204. For a level of gold, the parameter translator 214 outputs a value of ten (10) to add to the accumulator value 204.

As another example, the lookup table of the parameter translator 214 of FIG. 2 indicates that the 'number of machines in play' external parameter 210 translates in the following manner. For a number of machines value of fifteen hundred (1500) to two thousand (2000), the parameter translator 214 outputs a value of zero (0) to add to the accumulator value 204. For a number of machines value of one thousand (1000) to one thousand four hundred ninety-nine (1499), the parameter translator 214 outputs a value of two (2) to add to the accumulator value 204. For a number of machines value of five hundred (500) to nine hundred ninety-nine (999), the parameter translator 214 outputs a value of five (5) to add to the accumulator value 204. For a number of machines value of one (1) to four hundred ninety-nine (499), the parameter translator 214 outputs a value of ten (10) to add to the accumulator value 204. The translations of the lookup table for such a parameter can enable the system bonus manager 124 of FIG. 1 and/or an operator thereof to, for example, automatically enhance bonus levels across the casino floor 112 during off-hours and/or to temper bonus levels during busy hours.

As another example, the lookup table of the parameter translator 214 of FIG. 2 indicates that the 'bonus dollars paid during recent time window' external parameter 210 translates in the following manner. For a dollar amount of one hundred thousand ($100,000) or greater, the parameter translator 214 outputs a value of zero (0) to add to the accumulator value 204. For a dollar amount of fifty thousand ($50,000) to ninety-nine thousand nine hundred ninety-nine ($99,999), the parameter translator 214 outputs a value of five (5) to add to the accumulator value 204. For a dollar amount of ten thousand ($10,000) to forty-nine thousand nine hundred ninety-nine ($49,999), the parameter translator 214 outputs a value of ten (10) to add to the accumulator value 204. For a dollar amount of one thousand ($1,000) to nine thousand nine hundred ninety-nine ($9,999), the parameter translator 214 outputs a value of fifteen (15) to add to the accumulator value 204. For a dollar amount of zero ($0) to nine hundred ninety-nine ($999), the parameter translator 214 outputs a value of twenty (20) to add to the accumulator value 204. Such an approach for the 'bonus dollars paid during recent time window' parameter may moderate the volatility of bonus payouts over a period(s) of time.

The accumulated value 204 represents a dynamic sum of translated external parameter(s) 210 and translated local parameter(s) 212. That is, the accumulated value 204 for each gaming device 102-110 is continuously calculated and changes over time. When a bonus decision is to be made by the gaming device 102*a* of FIG. 2 (e.g., in response to receiving a token from the system bonus manager 124 of FIG. 1), the random number generator 220 generates the random number 206. Alternatively, the random number 206 may be received by the token receiver 218 as part of a token received from the system bonus manager 124. A comparator 222 compares the random number 206 to the accumulated value 204 to determine whether the triggered bonus decision results in a win or a loss.

In the illustrated example, the accumulated value is zero-based and has a value range of zero (0) to nine hundred ninety-nine (999). To determine whether the bonus decision is a win or a loss, the example comparator 222 of FIG. 2 determines whether the random number 206 is less than accumulated value 204. In the illustrated example, if the random number 206 is less than the accumulated value 204, the bonus is granted. If the random number 206 is equal to or greater than the accumulated value 204, the bonus is denied. For example, when the accumulated value 204 of the translated external parameter(s) 210 and the local parameter(s) 212 is two hundred twenty-seven (227), the bonus is granted when the random number 206 is less than two hundred twenty-seven (227).

In the illustrated example, the bonus module 202 also includes segment definitions 224 that further define one or more characteristics of a granted or denied bonus. In some examples, the segment definitions 224 are subsets calculated based on a percentage of the accumulated value 204. In such instances, the winning range defined by the accumulated value 204 is segmented according to one set of percentages and the losing range defined by the accumulated value 204 is segmented according to another set of percentages. When the segment definitions 224 are based on percentages of the accumulated value 204, the probability of each type of win (as defined by the segment definitions 224) increases as the probability of a bonus win increases. In some instances, the variability of the segment definitions 224 may not be a linear function. As an alternative to the percentage-based segmentation described above, the segment definitions 224 may be fixed (linear or non-linear) portions of the potential range of the accumulated value 204 (e.g., zero (0) to nine hundred ninety-nine (999)).

In addition to comparing the random number 206 to the accumulated value 204 to determine whether a bonus decision results in a grant or a denial, the example comparator 222 of FIG. 2 also compares the random number to the segment definitions 224. The example segment definitions 224 of FIG. 2 correspond to different types or characteristics of granted or denied bonuses and different type of scatter reactions that result from the bonus decision. As described in the examples listed below, depending on which segment of the segment definitions 224 the random number 206 falls within, the bonus decision may result in different types (e.g., sizes) of bonuses. For example, a size of a granted bonus can be defined by which of the segment definitions 224 the random number 206 falls within. In some examples, the segment definitions 224 define a range for the size (e.g., fifty (50) to one hundred (100) credits or dollars) of the granted bonus. In such instances, the random number generator 220 can be utilized to calculated a specific size (e.g., seventy-three (73) credits or dollars) within the bonus range that is to be credited to an account or balance of the gaming device 102*a*. Further, depending on which segment of the segment definitions 224 the random number 206 falls within, the bonus decision may results in different scatter reactions that affect other bonus decisions of other gaming devices 102*b*-110.

Figure 3:
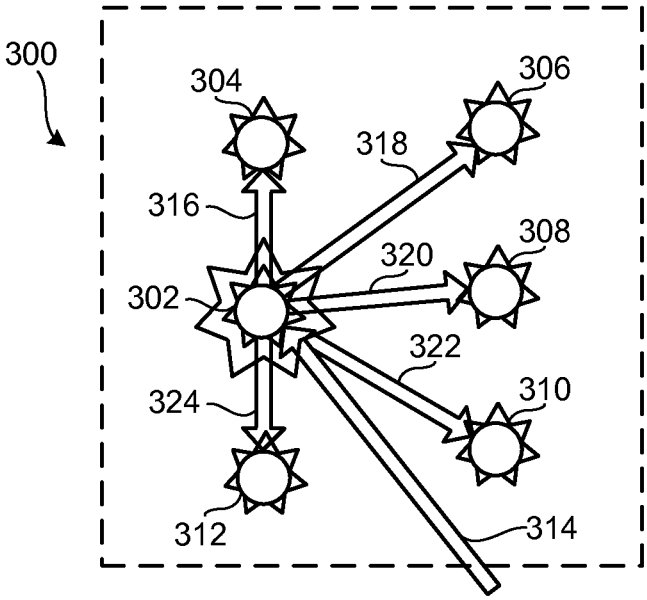
FIG. 3 is an illustration of a first example scattering reaction occurring in an example distributed bonus system.

In the illustrated example, the segment definitions 224 define a first segment of the winning range of the accumulated value 204 (i.e., zero (0) to two hundred twenty-six (226) in the above example) that corresponds to a first type of bonus capable of causing a large number of subsequent scatter reactions throughout the other gaming devices 102*b*-110. The subsequent scatter reactions resulting from a random number 206 falling within the first segment are illustrated in FIG. 3, which is described in greater detail below. To continue the above example, the first segment of the two hundred twenty-seven (227) accumulated value 204 is zero (0) to nine (9).

Figure 4:
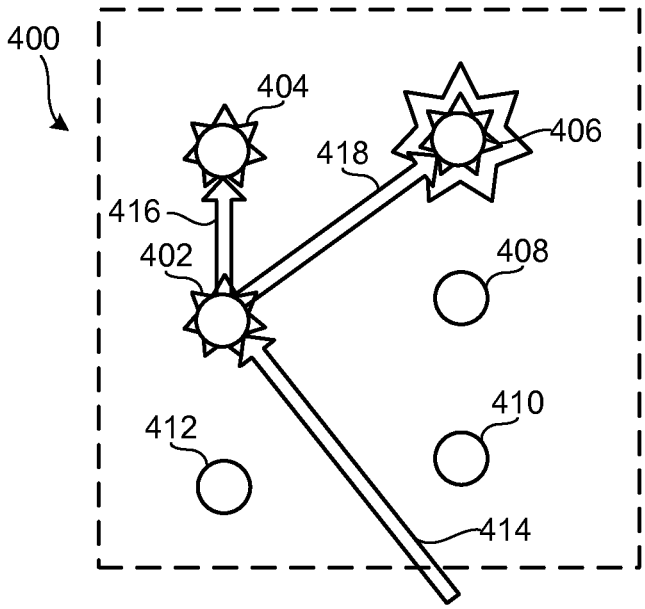
FIG. 4 is an illustration of a second example scattering reaction occurring in an example distributed bonus system.

Further, in the illustrated example, the segment definitions 224 define a second segment of the winning range of the accumulated value 204 that corresponds to a second type of bonus capable of causing a medium number of subsequent scatter reactions throughout the other gaming devices 102*b*-110. The subsequent scatter reactions resulting from a random number 206 falling within the second segment are illustrated in FIG. 4, which is described in greater detail below. To continue the above example, the second segment of the two hundred twenty-seven (227) accumulated value 204 is ten (10) to forty-nine (49).

Figure 5:
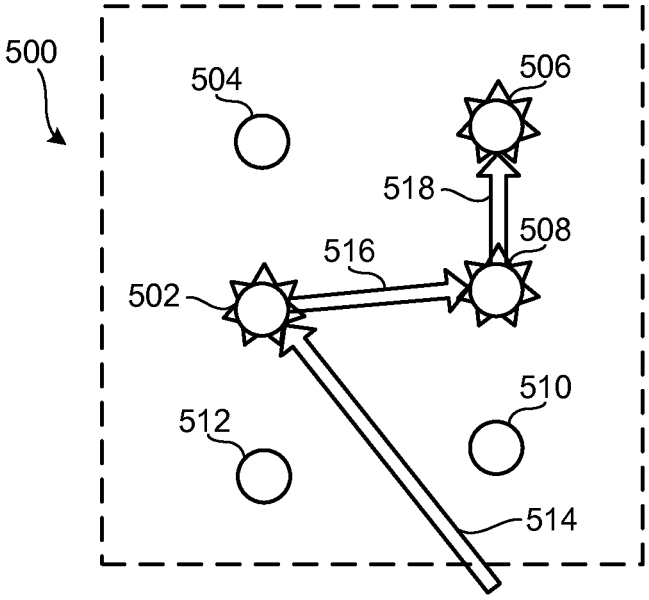
FIG. 5 is an illustration of a third example scattering reaction occurring in an example distributed bonus system.

Further, in the illustrated example, the segment definitions 224 define a third segment of the winning range of the accumulated value 204 that corresponds to a third type of bonus capable of causing a small number of subsequent scatter reactions throughout the other gaming devices 102*b*-110. The subsequent scatter reactions resulting from a random number 206 falling within the third segment are illustrated in FIG. 5, which is described in greater detail below. To continue the above example, the third segment of the two hundred twenty-seven (227) accumulated value 204 is fifty (50) to one hundred ninety-nine (199).

Figure 6:
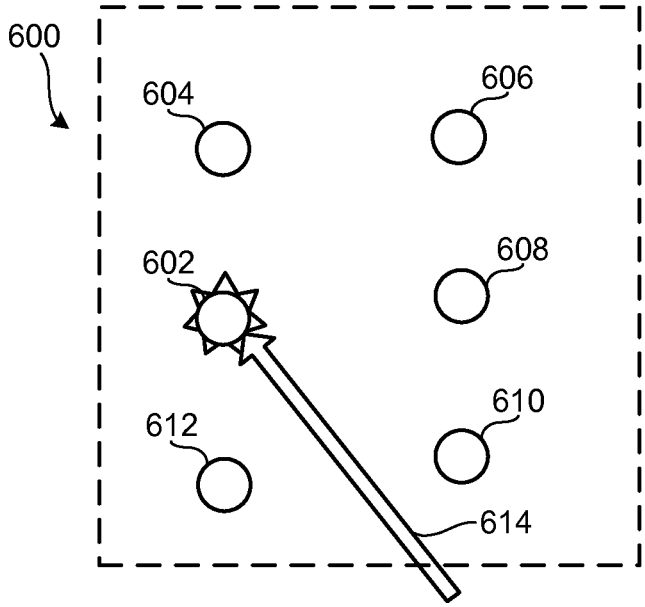
FIG. 6 is an illustration of a fourth example scattering reaction occurring in an example distributed bonus system.

Further, in the illustrated example, the segment definitions 224 define a fourth segment of the winning range of the accumulated value 204 that corresponds to a fourth type of bonus that does not cause subsequent reactions throughout the other gaming devices 102*b*-110. The lack of subsequent scatter reactions resulting from a random number 206 falling within the fourth segment is illustrated in FIG. 6, which is described in greater detail below. To continue the above example, the fourth segment of the two hundred twenty-seven (227) accumulated value 204 is two hundred (200) to two hundred twenty-six (226).

Figure 7:
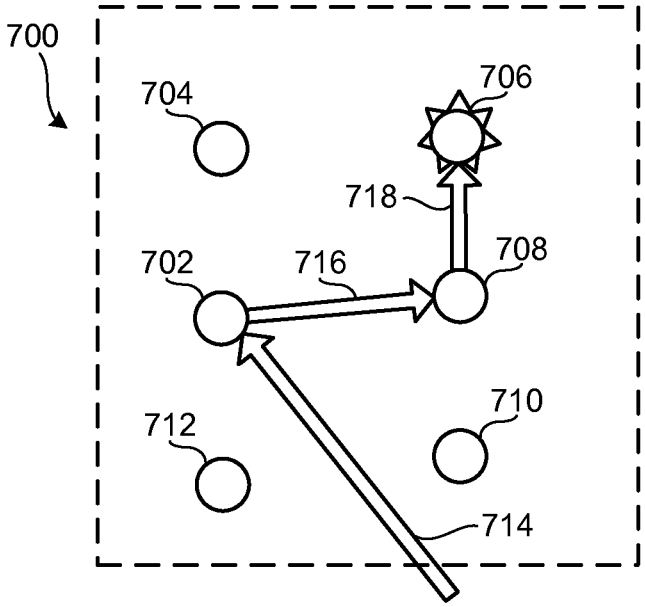
FIG. 7 is an illustration of a fifth example scattering reaction occurring in an example distributed bonus system.

The range of losing values defined by the accumulated value 204 can also be segmented. In the illustrated example, the segment definitions 224 define a fifth segment, which falls in the losing range of the accumulated value 204 (i.e., two hundred twenty-seven (227) to nine hundred ninety-nine (999)), that corresponds to a losing bonus that, however, is capable of causing at least one subsequent scatter reaction throughout the other gaming device(s) 102*b*-110. The subsequent scatter reactions resulting from a random number 206 falling within the fifth segment is illustrated in FIG. 7, which is described in greater detail below. To continue the above example, the fifth segment is two hundred twenty-seven (227) to four hundred ninety-nine (499).

Further, in the illustrated example, the segment definitions 224 define a sixth segment, which falls in the losing range of the accumulated value 204, that corresponds to a losing bonus that prohibits subsequent scatter reactions throughout the other gaming devices 102*b*-110. In other words, a bonus decision falling within the sixth segment absorbs token(s) or scatter token(s) without producing a win. To continue the above example, the sixth segment is five hundred (500) to nine hundred ninety-nine (999).

Thus, the comparator 222 determines whether a bonus decision resulted in a win or a loss (e.g., according to a comparison of the random number 206 to the accumulated value 204) and what type of granted or denied bonus the bonus decision produced (e.g., according to a comparison of the random number 206 to the segment definitions 224). When the type of bonus decision produces a bonus that generates one or more scatter tokens to be propagated to other gaming devices 102*b*-110, a token transmitter 226 conveys the generated scatter tokens to the system bonus manager 124 of FIG. 1. In the illustrated example, the generated scatter tokens inherit the local parameter(s) 212 of the gaming device 102*a* and/or the translated values of the local parameter(s) 212 as determined by the parameter translator 214. In some examples, the accumulated value 204 and/or portion(s) thereof are also inherited by the generated scatter tokens. Furthermore, each generated scatter tokens includes information indicative of a scatter pattern that the particular scatter token is to follow (e.g., according to the type of bonus and/or scatter token is generated based on which of the segment definitions 224 the random number 206 falls within).

The system bonus manager 124 of FIG. 1 receives the generated scatter tokens, if any, and propagates the scatter tokens among the casino floor 112 according to the scatter pattern associated with each generated scatter token. In some examples, the system bonus manager 124 verifies and/or otherwise checks the scatter token(s) received from the token transmitter 226 of FIG. 2. In some examples, the system bonus manager 124 alters and/or adds to the values of scatter tokens received from the token transmitter 226 of FIG. 2.

FIGS. 3-7 illustrate scatter patterns that may result from different types of bonus decisions. As described above, different types and degree of scatter tokens may result from a bonus decision depending on which of the segment definitions 224 the random number 206 falls within. FIG. 3 illustrates a first example scatter pattern 300 associated with a first one of the segment definitions 224. As described above, when the random number 206 falls within the first segment, the resulting bonus is capable of causing a large number of subsequent scatter reactions throughout the other gaming devices 102*b*-110. The gaming devices are represented in FIG. 3 by nodes 302-312. The gaming device making the bonus decision in response to an initial token 314 is represented with reference numeral 302. As indicated by the double star surrounding the node 302, the gaming device making the bonus decision receives a large bonus according to the comparison of the random number 206 to the accumulated 204 and the segment definitions 224 thereof. Additionally, the bonus decision associated with the node 302 in response to the initial token 314 results in a plurality of scatter tokens 316-324 that carry a high probability of generated winning bonus decisions at the nodes 304-312 for which the scatter tokens 316-324 are destined. The scatter tokens 316-324 are conveyed from the token transmitter 226 of the SCI 200 to the system bonus manager 124 of FIG. 1, which propagates the scatter tokens 316-324 according to the scatter patterns associated therewith. In some examples, the system bonus manager 124 receives any scatter tokens resulting from the bonus decision described above and distributes the scatter tokens to randomly selected gaming devices. In the illustrated example, the scatter tokens 316-324 each result in a winning bonus of a mid-range size at nodes 304-312, respectively, as indicated by the single star surrounding the nodes 304-312.

FIG. 4 illustrates a second example scatter pattern 400 associated with a second one of the segment definitions 224. As described above, when the random number 206 falls within the second segment, the resulting bonus is capable of causing a medium number of subsequent scatter reactions throughout the other gaming devices 102*b*-110. The gaming devices are represented in FIG. 4 by nodes 402-412. The gaming device making the bonus decision in response to an initial token 414 is represented with reference numeral 402. As indicated by the single star surrounding the node 402, the gaming device making the bonus decision receives a normal-sized bonus according to the comparison of the random number 206 to the accumulated 204 and the segment definitions 224 thereofdditionally, the bonus decision associated with the node 402 in response to the initial token 414 results in a plurality of scatter tokens 416 and 418 that carry a medium probability of generated winning bonus decisions at the nodes 404 and 406 for which the scatter tokens 416 and 418 are destined. The scatter tokens 416 and 418 are conveyed from the token transmitter 226 of the SCI 200 to the system bonus manager 124 of FIG. 1, which propagates the scatter tokens 416 and 418 according to the scatter patterns associated therewith. In the illustrated example, the first scatter token 416 results in a normal-sized winning bonus at node 404. Further, in the illustrated example, the second scatter token 418 results in a large bonus at node 406.

FIG. 5 illustrates a third example scatter pattern 500 associated with a third one of the segment definitions 224. As described above, when the random number 206 falls within the third segment, the resulting bonus is capable of causing a small number of subsequent scatter reactions throughout the other gaming devices 102*b*-110. The gaming devices are represented in FIG. 5 by nodes 502-512. The gaming device making the bonus decision in response to an initial token 514 is represented with reference numeral 502. As indicated by the single star surrounding the node 502, the gaming device making the bonus decision receives a normal-sized bonus according to the comparison of the random number 206 to the accumulated 204 and the segment definitions 224 thereofdditionally, the bonus decision associated with the node 502 in response to the initial token 514 results in a single scatter token 516 that carries a small probability of generating a winning bonus decision at the node 508 for which the scatter token 516 is destined. The scatter token 516 is conveyed from the token transmitter 226 of the SCI 200 to the system bonus manager 124 of FIG. 1, which propagates the scatter token 516 according to the scatter pattern associated therewith. In the illustrated example, the scatter token 516 results in a normal-sized winning bonus at node 508. Further, in the illustrated example, the winning bonus decision made at the gaming device represented by node 508, in response to the scatter token 516, results in a secondary scatter token 518. The secondary scatter token 518 propagates through the casino floor 112 to another gaming device represented by node 506. In the illustrated example, the secondary scatter token 518 triggers a bonus decision at node 506 that results in a normal-sized bonus win.

FIG. 6 illustrates a fourth example scatter pattern 600 associated with a fourth one of the segment definitions 224. As described above, when the random number 206 falls within the fourth segment, the resulting bonus does not cause subsequent scatter reactions throughout the other gaming devices 102*b*-110. The gaming devices are represented in FIG. 6 by nodes 602-612. The gaming device making the bonus decision in response to an initial token 614 is represented with reference numeral 602. As indicated by the single star surrounding the node 602, the gaming device making the bonus decision receives a normal-sized bonus according to the comparison of the random number 206 to the accumulated 204 and the segment definitions 224 thereofnlike the previously described scatter patterns 300, 400, and 500 of FIGS. 3, 4, and 5, respectively, the bonus decision associated with the node 602 in response to the initial token 614 of FIG. 6 does not result in any scatter tokens.

FIG. 7 illustrates a fifth example scatter pattern 700 associated with a fifth one of the segment definitions 224. As described above, when the random number 206 falls within the fifth segment, the resulting bonus decision is a loss that, however, is capable of causing at least one subsequent scatter reaction throughout the other gaming device(s) 102*b*-110. The gaming devices are represented in FIG. 7 by nodes 702-712. The gaming device making the bonus decision in response to an initial token 714 is represented with reference numeral 702. As indicated by the lack of a star surrounding the node 702, the gaming device making the bonus decision does not receive a bonus according to the comparison of the random number 206 to the accumulated 204. Additionally, the bonus decision associated with the node 702 in response to the initial token 714 results in a single scatter token 716 that carries a small probability of generating a winning bonus decision at the node 708 for which the scatter token 716 is destined. The scatter token 716 is conveyed from the token transmitter 226 of the SCI 200 to the system bonus manager 124 of FIG. 1, which propagates the scatter token 716 according to the scatter pattern associated therewith. In the illustrated example, the scatter token 716 results in bonus loss at node 708. Further, in the illustrated example, the losing bonus decision made at the gaming device represented by node 708, in response to the scatter token 716, results in a secondary scatter token 718. The secondary scatter token 718 propagates through the casino floor 112 to another gaming device represented by node 706. In the illustrated example, the secondary scatter token 718 triggers a bonus decision at node 706 that results in a normal-sized bonus win.

While an example manner of implementing the example SCIs 128 of FIG. 1 has been illustrated in FIG. 2, one or more of the elements, processes and/or devices illustrated in FIG. 2 may be combined, divided, re-arranged, omitted, eliminated and/or implemented in any other way. Further, the example bonus module 202, the example accumulator 208, the example parameter translator 214, the example local parameter retriever 216, the example token receiver 218, the example random number generator 220, the example comparator 222, the example segment definitions 224, the example token transmitter 226, and/or, more generally, the example SCI 200 of FIG. 2 may be implemented by hardware, software, firmware and/or any combination of hardware, software and/or firmware. Thus, for example, any of the example bonus module 202, the example accumulator 208, the example parameter translator 214, the example local parameter retriever 216, the example token receiver 218, the example random number generator 220, the example comparator 222, the example segment definitions 224, the example token transmitter 226, and/or, more generally, the example SCI 200 of FIG. 2 can be implemented by one or more circuit(s), programmable processor(s), application specific integrated circuit(s) (ASIC(s)), programmable logic device(s) (PLD(s)) and/or field programmable logic device(s) (FPLD(s)), etc. When any of the appended claims are read to cover a purely software and/or firmware implementation, at least one the example bonus module 202, the example accumulator 208, the example parameter translator 214, the example local parameter retriever 216, the example token receiver 218, the example random number generator 220, the example comparator 222, the example segment definitions 224, the example token transmitter 226, and/or, more generally, the example SCI 200 of FIG. 2 are hereby expressly defined to include a tangible medium such as a memory, DVD, CD, etc., storing the software and/or firmware. Further still, the example bonus module 202, the example accumulator 208, the example parameter translator 214, the example local parameter retriever 216, the example token receiver 218, the example random number generator 220, the example comparator 222, the example segment definitions 224, the example token transmitter 226, and/or, more generally, the example SCI 200 of FIG. 2 may include one or more elements, processes and/or devices in addition to, or instead of, those illustrated in FIG. 2, and/or may include more than one of any or all of the illustrated elements, processes and devices.

Figure 8:
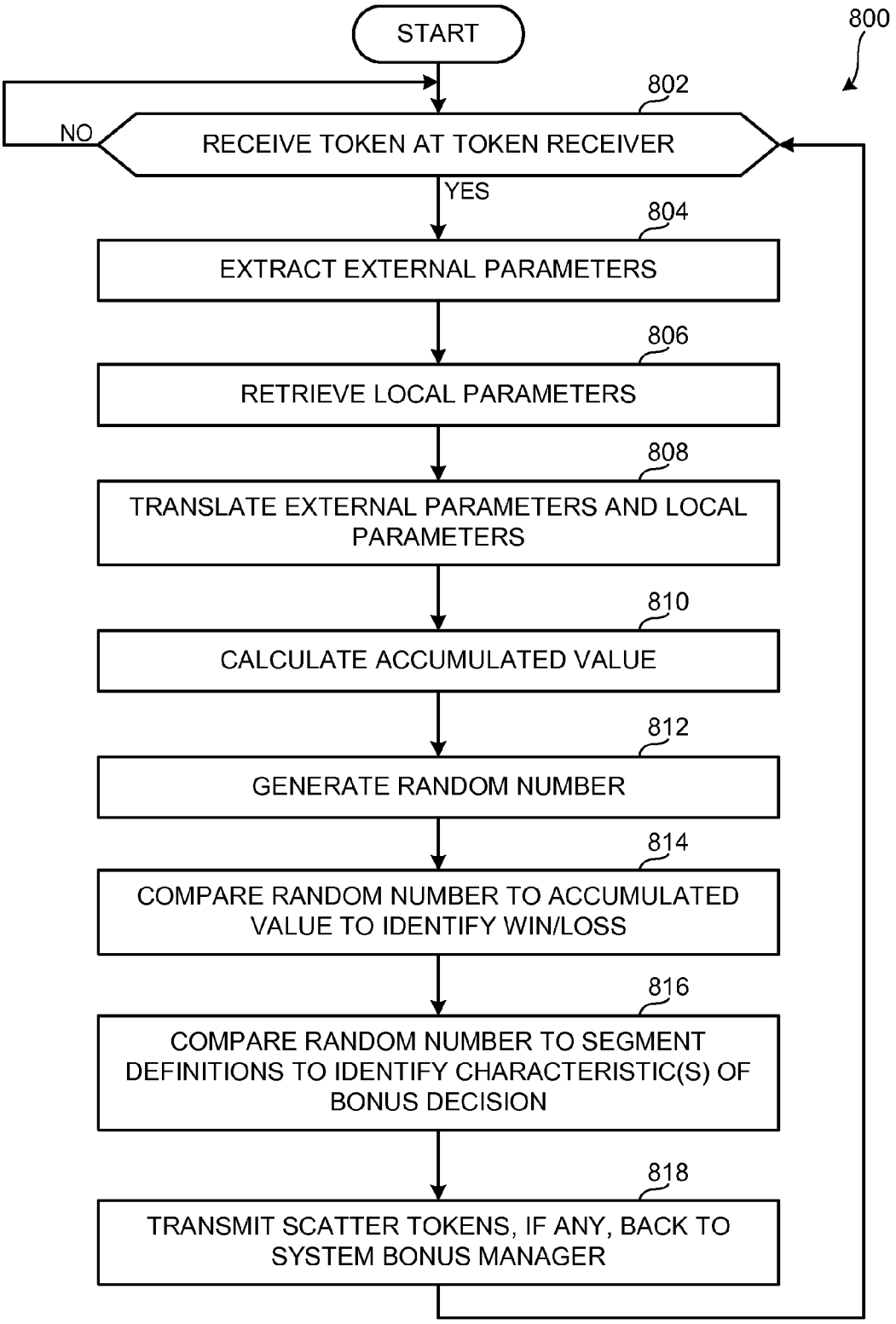
FIG. 8 is a flow diagram representative of an example process that may be implemented using example machine readable instructions that may be executed to implement the example SCI(s) of FIGS. 1 and/or 2.

FIG. 8 depicts an example flow diagram representative of a process 800 that may be implemented using, for example, computer readable instructions that may be used to implement the example SCI(s) 128 of FIGS. 1 and/or 2. The example process 800 of FIG. 8 may be performed using a processor, a controller and/or any other suitable processing device. For example, the example process 800 of FIG. 8 may be implemented using coded instructions (e.g., computer readable instructions) stored on a tangible computer readable medium such as a flash memory, a read-only memory (ROM), and/or a random-access memory (RAM). As used herein, the term tangible computer readable medium is expressly defined to include any type of computer readable storage and to exclude propagating signals. Additionally or alternatively, the example process 800 of FIG. 8 may be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Alternatively, some or all of the example process 800 of FIG. 8 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, some or all of the example process 800 of FIG. 8 may be implemented manually or as any combination(s) of any of the foregoing techniques, for example, any combination of firmware, software, discrete logic and/or hardware. Further, although the example process 800 of FIG. 8 is described with reference to the flow diagram of FIG. 8, other methods of implementing the process 800 of FIG. 8 may be employed. For example, the order of execution of the blocks may be changed, and/or some of the blocks described may be changed, eliminated, sub-divided, or combined. Additionally, any or all of the example process 800 of FIG. 8 may be performed sequentially and/or in parallel by, for example, separate processing threads, processors, devices, discrete logic, circuits, etc.

In the illustrated example process 800 of FIG. 8, the token receiver 218 of the SCI 200 of the video slot machine or gaming device 102*a* may receive a token (e.g., the initial tokens 314, 414, 514, 614, and 714 of FIGS. 3-7, respectively) from the system bonus manager 124 of FIG. 1 (block 802). The token is a bonus decision trigger that initiates a bonus decision on the gamine device 102*a*. When a token is received by the token receiver 218, the external parameter(s) 210 described above in connection with FIG. 2 are extracted from the token (block 804). For example, the received token may include data that includes a value for, for example, a machine location associated with a gaming device from which the token originated (e.g., as a result of a winning bonus decision), a player club level, a casino floor bonus power level, and/or a random system 'kicker.' These or other external parameters and the values thereof may be inherited from an originating gaming device. Alternatively, some or all of the received external parameters 210 may have been adjusted at the system bonus manager 124 by, for example, a system administrator exerting control of the bonus payouts over the casino floor 112 as a whole.

In addition to the external parameter(s) 210, the local parameter(s) 212 are also extracted when the token is received by the token receiver 218 (block 806). In particular, the local parameter retriever 216 of FIG. 2 extracts the local parameter(s) 212. For example, the local parameter(s) 212 can include data that includes a value for a time spent playing on the gaming device 102*a* for a user, a special value associated with a certain game or version of a game implemented by the gaming device 102*a*, a time since the last win or bonus on the gaming device 102*a*, an average number of coins or credits per play on the gaming device 102*a* over a certain period of time, an average speed of play no the gaming device 102*a* over a certain period of time, a theoretical win value, and/or a local random 'kicker.'

The external parameter(s) 210 and the local parameter(s) 212 are conveyed to the parameter translator 214 of FIG. 2, which translates the external parameter(s) 210 and the local parameter(s) 212 (block 808). As described above in connection with FIG. 2, the accumulated value 204 is calculated by summing the translated external and local parameter(s) 210 and 212 (block 810). In some examples, one or more of the external parameter(s) 210 and/or the local parameter(s) 212 (e.g., the 'kicker' values) do not require translation by the parameter translator 214, which is capable of recognizing which of the external and local parameter(s) 210 and 212 do not require translation and can be added to the accumulated value 204 without translation.

The example random number generator 220 of FIG. 2 generates the random number 206 (block 812). To determine whether the bonus decision triggered by the received token is a win or loss, the comparator 222 of FIG. 2 compares the random number 206 to the accumulated value 204 (block 814). As described above in connection with FIG. 2, the accumulated value 204 defines a range of numbers in which the random number 206 may fall for the bonus decision to result in a win. Additionally, the winning range defined by the accumulator value 204, along with the losing range also defined by the accumulator 204, is segmented according to the segment definitions 224. In the illustrated example, the segment definitions 224 are calculated as a plurality of percentages of the ranges defined by the accumulator value 204.

The comparator 222 also compares the random number 206 to the segment definitions 224 to determine which of the segment definitions 224 the random number 206 falls within (block 816). As described above, determining within which of the segment definitions 224 the random number 206 falls determines additional characteristics of the bonus. For example, a size of a granted bonus can be defined by which of the segment definitions 224 the random number 206 falls within. In some examples, the segment definitions 224 define a range for the size (e.g., fifty (50) to one hundred (100) credits or dollars) of the granted bonus. In such instances, the random number generator 220 can be utilized to calculated a specific size (e.g., seventy-three (73) credits or dollars) within the bonus range that is to be credited to an account or balance of the gaming device 102*a*.

In the illustrated example, a number and type of scatter tokens resulting from the bonus decision, if any, is defined by which of the segment definitions 224 the random number 206 falls within. As described above, the segment definition 224 in which the random number 206 falls can determine that, for example, a plurality of scatter tokens, a single scatter token, no scatter tokens, and/or token(s) resulting in secondary scatter token(s) are sent back to the system bonus manager 124 for propagation throughout the casino floor 112 (block 818).

In some examples, the system bonus manager 124 receives any scatter tokens resulting from the bonus decision described above and distributes the scatter tokens to randomly selected gaming devices. In some examples, the gaming device for which a scatter token is destined is designated in data associated with the scatter token.

Figure 9:
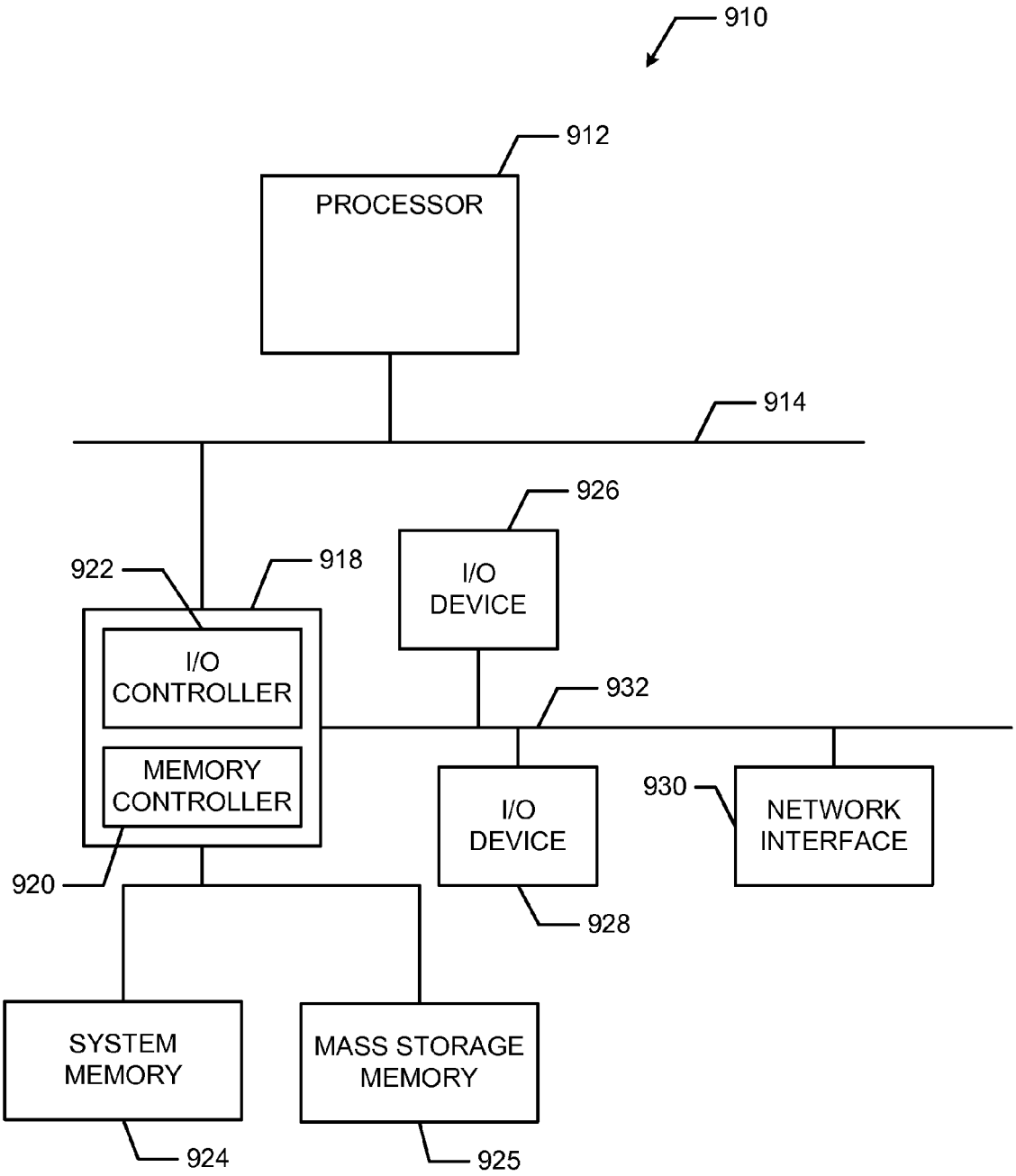
FIG. 9 is a block diagram of an example processor system that may be used to execute the machine readable instructions of FIG. 8 and/or to implement the example SCI(s) of FIGS. 1 and/or 2.

FIG. 9 is a block diagram of an example processor system that may be used to execute the machine readable instructions of FIG. 8 and/or to implement one or more of the example components of the example gaming system 100 of FIG. 1, such as the SCIs 128*a-f* and/or the example SCI 128*a* described in connection with FIG. 2. As shown in FIG. 9, the processor system 910 includes a processor 912 that is coupled to an interconnection bus 914. The processor 912 may be any suitable processor, processing unit or microprocessor. Although not shown in FIG. 9, the system 910 may be a multi-processor system and, thus, may include one or more additional processors that are different, identical or similar to the processor 912 and that are communicatively coupled to the interconnection bus 914.

The processor 912 of FIG. 9 is coupled to a chipset 918, which includes a memory controller 920 and an input/output (I/O) controller 922. The chipset 918 provides I/O and memory management functions as well as a plurality of general purpose and/or special purpose registers, timers, etc. that are accessible or used by one or more processors coupled to the chipset 918. The memory controller 920 performs functions that enable the processor 912 (or processors if there are multiple processors) to access a system memory 924 and a mass storage memory 925.

The system memory 924 may include any desired type of volatile and/or non-volatile memory such as, for example, static random access memory (SRAM), dynamic random access memory (DRAM), flash memory, read-only memory (ROM), etc. The mass storage memory 925 may include any desired type of mass storage device including hard disk drives, optical drives, tape storage devices, etc.

The I/O controller 922 performs functions that enable the processor 912 to communicate with peripheral input/output (I/O) devices 926 and 928 and a network interface 930 via an I/O bus 932. The I/O devices 926 and 928 may be any desired type of I/O device such as, for example, a keyboard, a video display or monitor, a mouse, etc. The network interface 930 may be, for example, an Ethernet device, an asynchronous transfer mode (ATM) device, an 802.11 device, a DSL modem, a cable modem, a cellular modem, etc. that enables the processor system 910 to communicate with another processor system.

While the memory controller 920 and the I/O controller 922 are depicted in FIG. 9 as separate blocks within the chipset 918, the functions performed by these blocks may be integrated within a single semiconductor circuit or may be implemented using two or more separate integrated circuits.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Several embodiments are described above with reference to the drawings. These drawings illustrate certain details of specific embodiments that implement the systems and methods and programs of the present invention. However, describing the invention with drawings should not be construed as imposing on the invention any limitations associated with features shown in the drawings. It will be understood that the invention disclosed and defined in this specification extends to all alternative combinations of two or more of the individual features mentioned or evident from the text or drawings. All of these different combinations constitute various alternative aspects of the invention.

The present invention contemplates methods, systems and program products on any electronic device and/or machine-readable media suitable for accomplishing its operations. Certain embodiments of the present invention may be implemented using an existing computer processor and/or by a special purpose computer processor incorporated for this or another purpose or by a hardwired system, for example.

Embodiments within the scope of the present invention include program products comprising machine-readable media for carrying or having machine-executable instructions or data structures stored thereon. Such machine-readable media can be any available media that can be accessed by a general purpose or special purpose computer or other machine with a processor. By way of example, such machine-readable media may comprise RAM, ROM, PROM, EPROM, EEPROM, Flash, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such a connection is properly termed a machine-readable medium. Combinations of the above are also included within the scope of machine-readable media. Machine-executable instructions comprise, for example, instructions and data which cause a general purpose computer, special purpose computer, or special purpose processing machines to perform a certain function or group of functions.

The invention claimed is:

1. A method, comprising:

analyzing a scatter token received from a first gaming device generated at the first gaming device based on a bonus decision;

identifying a scatter pattern defined in the received scatter token;

altering the scatter token before propagating the scatter token throughout a network of gaming devices; and propagating the scatter token throughout the network of gaming devices according to the identified scatter pattern.

2. A method as defined in claim 1, wherein altering the scatter token comprises changing a value of the scatter token to maintain a cumulative bonus output of the network of gaming devices.

3. A method as defined in claim 1, further comprising, in response to receiving a second scatter token, propagating the second scatter token to randomly selected ones of the gaming devices of the network.

4. A method as defined in claim 1, further comprising conveying an initial token to the first gaming device to initiate a bonus decision at the first gaming device that generates the scatter token.

5. A method as defined in claim 1, wherein the scatter pattern is indicative of a number of scatter reactions to be received by the gaming devices of the network.

6. A method as defined in claim 1, wherein the scatter token is indicative of a probability of a bonus win at a second gaming device for which the scatter token is destined.

7. A tangible computer readable storage medium comprising instructions that, when executed, cause a machine to at least:

analyze a scatter token received from a first gaming device generated at the first gaming device based on a bonus decision;

identify a scatter pattern defined in the received scatter token;

alter the scatter token before propagating the scatter token throughout a network of gaming devices; and propagate the scatter token throughout the network of gaming devices according to the identified scatter pattern.

8. A storage medium as defined in claim 7, wherein the instructions cause the machine to alter the scatter token by changing a value of the scatter token to maintain a cumulative bonus output of the network of gaming devices.

9. A storage medium as defined in claim 7, wherein the instructions cause the machine to, in response to receiving a second scatter token, propagate the second scatter token to randomly selected ones of the gaming devices of the network.

10. A storage medium as defined in claim 7, wherein the instructions cause the machine to convey an initial token to the first gaming device to initiate a bonus decision at the first gaming device that generates the scatter token.

11. A storage medium as defined in claim 7, wherein the scatter pattern is indicative of a number of scatter reactions to be received by the gaming devices of the network.

12. A storage medium as defined in claim 7, wherein the scatter token is indicative of a probability of a bonus win at a second gaming device for which the scatter token is destined.

13. An apparatus comprising:

an interface to communicate with first and second gaming devices; and a bonus manager to:

convey an initial token to the first gaming device to initiate a bonus decision;

analyze a first scatter token received from the first gaming device generated at the first gaming device based on the bonus decision;

identify a scatter pattern defined in the first scatter token;

alter the first scatter token before propagating the scatter token to the second gaming; and propagate the first scatter token to the second gaming device according when the scatter pattern indicates that the second gaming device is to receive the scatter token.

14. An apparatus as defined in claim 13, wherein the bonus manager is to alter the first scatter token by changing a value of the first scatter token to maintain a cumulative bonus output of the first and second gaming devices.

15. An apparatus as defined in claim 13, wherein the bonus manager is to, in response to receiving a second scatter token, propagate the second scatter token to randomly selected ones of a gaming device network.

16. An apparatus as defined in claim 13, wherein the scatter pattern is indicative of a number of scatter reactions to be received by gaming devices of a gaming device network.

17. An apparatus as defined in claim 13, wherein the scatter token is indicative of a probability of a bonus win at the second gaming device.

* * * * *

UNITED STATES PATENT AND TRADEMARK OFFICE

CERTIFICATE OF CORRECTION

PATENT NO. : 8,926,426 B2
APPLICATION NO. : 13/733779
DATED : January 6, 2015
INVENTOR(S) : Gary Frerking It is certified that error appears in the above-identified patent and that said Letters Patent is hereby corrected as shown below:

In The Claims

Column 18, line 63: delete "according"

Signed and Sealed this
Fourth Day of August, 2015

Michelle K. Lee

Michelle K. Lee
*Director of the United States Patent and Trademark Office*